US009831613B2

(12) United States Patent
Liu et al.

(10) Patent No.: US 9,831,613 B2
(45) Date of Patent: Nov. 28, 2017

(54) SHIELDING CAGE OF CONNECTOR

(71) Applicant: Tyco Electronics (Shanghai) Co. Ltd., Shanghai (CN)

(72) Inventors: Wenyu Liu, Shanghai (CN); Hongqiang Han, Shanghai (CN); Youwei Pan, Shanghai (CN)

(73) Assignee: Tyco Electronics (Shanghai) Co. Ltd., Shanghai (CN)

( * ) Notice: Subject to any disclaimer, the term of this patent is extended or adjusted under 35 U.S.C. 154(b) by 0 days.

(21) Appl. No.: 15/142,672

(22) Filed: Apr. 29, 2016

(65) Prior Publication Data

US 2016/0322757 A1 Nov. 3, 2016

(30) Foreign Application Priority Data

Apr. 30, 2015 (CN) ..... 2015 2 0275614 U

(51) Int. Cl.

| | |
|---|---|
| ***H01R 9/03*** | (2006.01) |
| ***H01R 13/6583*** | (2011.01) |
| *H01R 4/64* | (2006.01) |
| *H01R 13/24* | (2006.01) |
| *H01R 13/6587* | (2011.01) |

(52) U.S. Cl.

CPC ..... *H01R 13/6583* (2013.01); *H01R 4/64* (2013.01); *H01R 13/2442* (2013.01); *H01R 13/6587* (2013.01)

(58) Field of Classification Search

CPC ..... H01R 13/6583; H01R 13/2442; H01R 13/6587; H01R 4/64

USPC ..... 439/607.2, 607.21, 607.17, 607.28, 939

See application file for complete search history.

(56) References Cited

U.S. PATENT DOCUMENTS

| | | | | |
|---|---|---|---|---|
| 6,478,622 | B1 * | 11/2002 | Hwang | H01R 13/65802 385/92 |
| 7,001,217 | B2 * | 2/2006 | Bright | G02B 6/4201 439/607.2 |
| 7,869,224 | B1 * | 1/2011 | Yang | G02B 6/4284 174/350 |
| 8,033,741 | B2 * | 10/2011 | Yoshikawa | G02B 6/4201 385/92 |
| 8,449,331 | B2 * | 5/2013 | Phillips | H01R 13/6581 361/704 |
| 8,747,159 | B2 * | 6/2014 | Liu | G02B 6/428 439/607.2 |
| 8,890,004 | B2 * | 11/2014 | Wickes | H01R 13/6583 174/354 |
| 2009/0176409 | A1 * | 7/2009 | Oki | H01R 13/65802 439/607.2 |

* cited by examiner

*Primary Examiner* — Khiem Nguyen
(74) *Attorney, Agent, or Firm* — Barley Snyder

(57) ABSTRACT

A shielding cage of a connector is disclosed. The shielding cage includes an opening defined by four walls and configured to receive a plug of a mating connector, and a plurality of shielding spring sheets held on the four walls, each shielding spring sheet having an inner spring sheet portion located inside the opening and an outer spring sheet portion located outside the opening.

16 Claims, 6 Drawing Sheets

SHIELDING CAGE OF CONNECTOR

CROSS-REFERENCE TO RELATED APPLICATION

This application claims the benefit of the filing date under 35 U.S.C. §119(a)-(d) of Chinese Patent Application No. CN201520275614.0, filed on Apr. 30, 2015.

FIELD OF THE INVENTION

The present invention relates to a shielding cage of an electrical connector, and more particularly, to a shielding cage having a spring sheet with anti-electromagnetic interference performance.

BACKGROUND

In the prior art, it is known for a shielding cage of a high-speed electrical connector transmitting data at high speed to be provided with a spring sheet to limit electromagnetic interference. The known spring sheet meets the higher anti-electromagnetic interference requirements of the high-speed connector. In the prior art, the known spring sheet is provided inside an opening of a shielding cage of the connector, and doesn't extend to an outer wall of the opening of the shielding cage.

When the shielding cage with the known spring sheet is mounted in an installation opening of an apparatus housing, a conductive gasket must additionally be mounted between the shielding cage and the apparatus housing to achieve the desired electromagnetic shielding effect. The conductive gasket is pressed between the spring sheet of the shielding cage and the apparatus housing. Furthermore, in order to reliably fix the conductive gasket and the shielding cage onto the installation opening of the apparatus housing, it is necessary to provide a fixation plate, one side of which is connected to the shielding cage and the other side of which is connected to the apparatus housing. Using a spring sheet to limit electromagnetic interference in the prior art thus additionally requires both the conductive gasket and the fixation plate, which increase the cost and complexity of assembling the high-speed connector.

SUMMARY

An object of the invention, among others, is to provide a shielding cage of a connector that can be assembled simply and at a lower cost. The disclosed shielding cage includes an opening defined by four walls and configured to receive a plug of a mating connector, and a plurality of shielding spring sheets held on the four walls, each shielding spring sheet having an inner spring sheet portion located inside the opening and an outer spring sheet portion located outside the opening.

BRIEF DESCRIPTION OF THE DRAWINGS

The invention will now be described by way of example with reference to the accompanying figures, of which.

DETAILED DESCRIPTION OF EMBODIMENT(S)

The invention is described in greater detail below with reference to embodiments of a shielding cage of a connector. This invention may, however, be embodied in many different forms and should not be construed as limited to the embodiments set forth herein; rather, these embodiments are provided so that this disclosure will be thorough and complete and still fully convey the scope of the invention to those skilled in the art.

Figure 1:
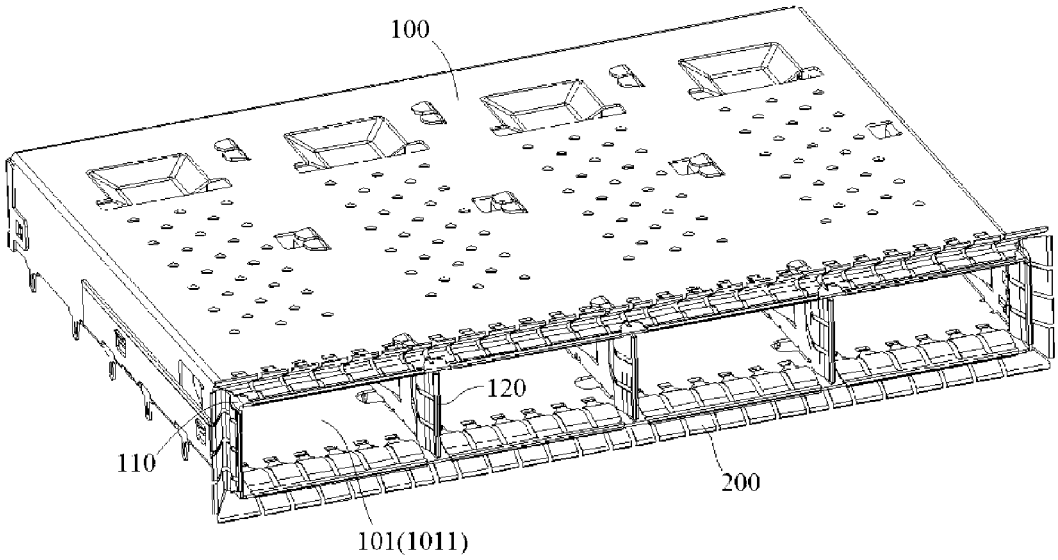
FIG. 1 is a perspective view of a shielding cage of a connector according to the present invention.

A shielding cage 100 according to the invention is shown generally in FIG. 1. The shielding cage 100 may receive a terminal assembly (not shown). The shielding cage 100 includes an opening 101 and a plurality of shielding spring sheets 200. The major components of the invention will now be described in greater detail.

Figure 3:
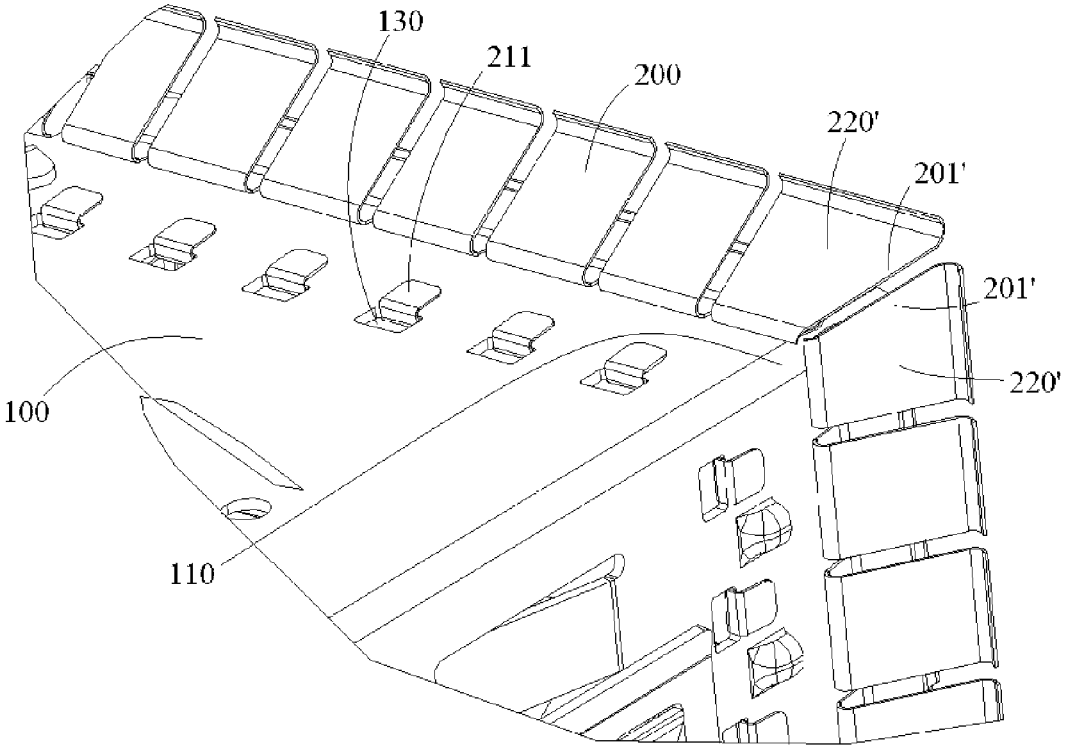
FIG. 3 is an enlarged view of a corner of the shielding cage of FIG. 1.

As shown in FIG. 1, the opening 101 is defined by four walls and configured to receive a plug of a mating connector. At least one spacer 120, which is used to divide the opening 101 of the shielding cage 100 into a plurality of plug-in ports 1011, is provided in the opening 101 of the shielding cage 100. The opening 101 also has a plurality of corners 110, as shown in FIG. 1. A plurality of slots 130 are disposed on the shielding cage 100 around the opening 101, as shown in FIG. 3.

Figure 2:
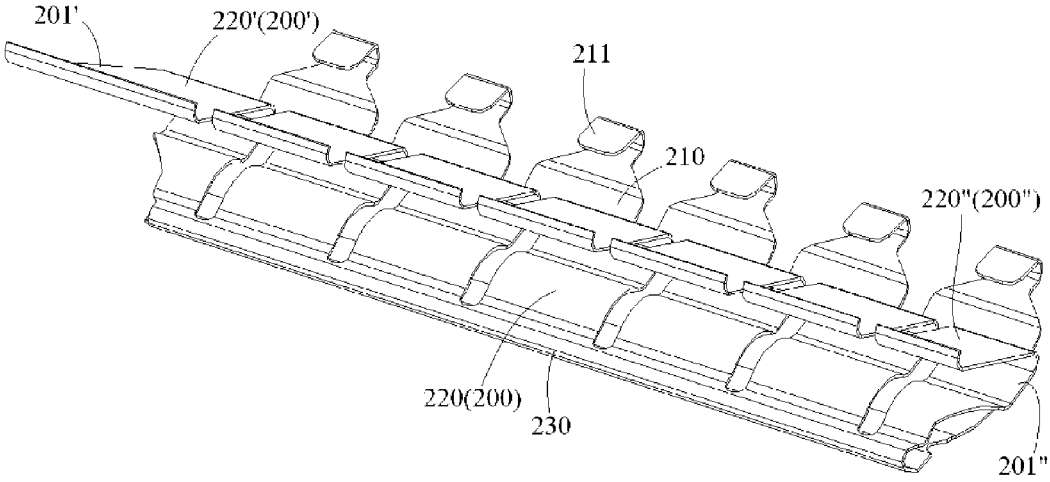
FIG. 2 is a perspective view of a set of shielding spring sheets according to the invention.
Figure 6:
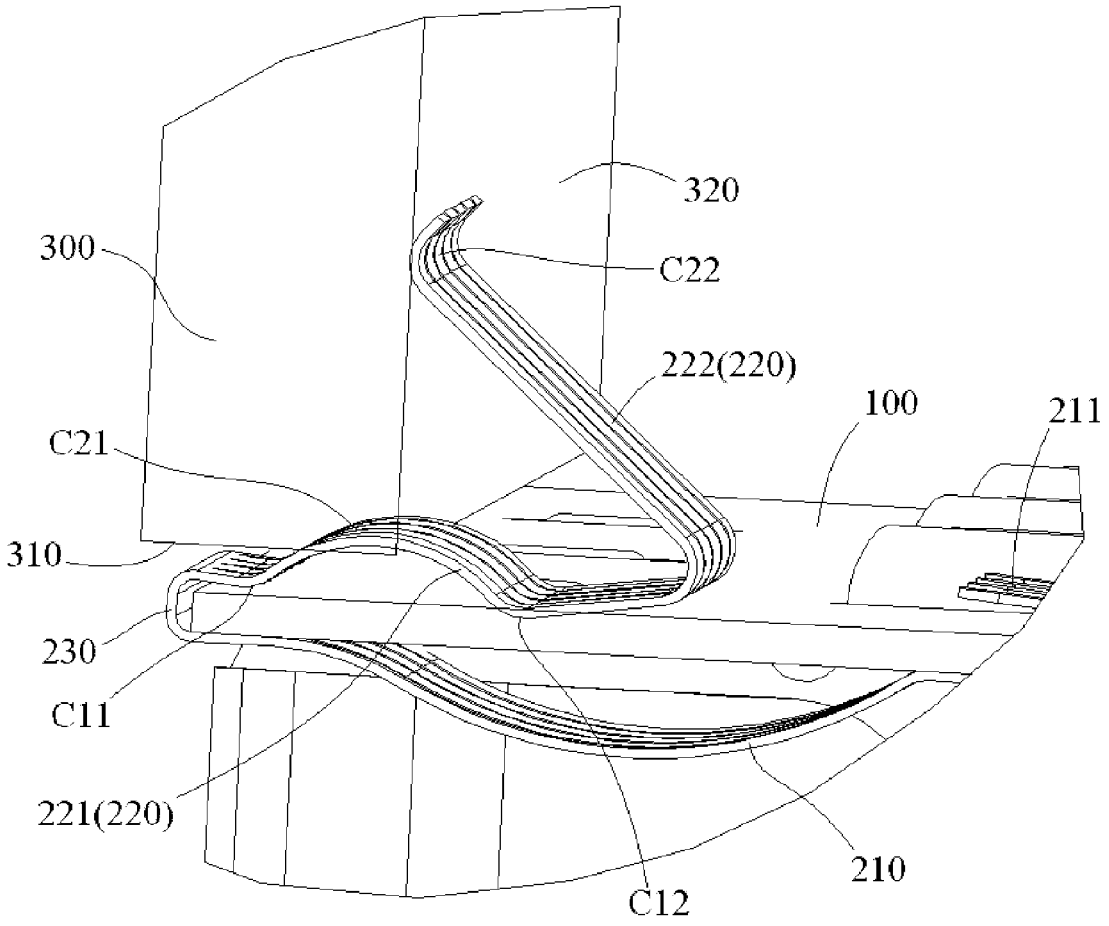
FIG. 6 is an enlarged view of the shielding cage and apparatus housing of FIG. 5.

As shown in FIG. 2, each shielding spring sheet 200 has a connection portion 230 which is located between the inner spring sheet portions 210 and the outer spring sheet portions 220 and used to integrally connect the inner spring sheet portions 210 to the outer spring sheet portions 220. Each inner spring sheet portion 210 has an end 211. As shown in FIG. 6, the outer spring sheet portion 220 comprises a first bending portion 221 and a second bending portion 222 connected to the first bending portion 221. The shielding spring sheet 200, as shown in FIG. 2, has outer spring sheet portions 220', 220" at opposite ends of the shielding spring sheet 200. These outer spring sheet portions 220', 220" each have side portions 201', 201", respectively.

The assembly of the shielding cage 100 including the opening 101 and the plurality of shielding spring sheets 200 will now be described in greater detail.

As shown in FIG. 1, the plurality of shielding spring sheets 200 are held on the four walls of the opening 101 of the shielding cage 100, and are used to improve the anti-electromagnetic interference performance of the connector, thus the shielding spring sheets 200 may also be called spring sheets of anti-electromagnetic interference.

Figure 4:
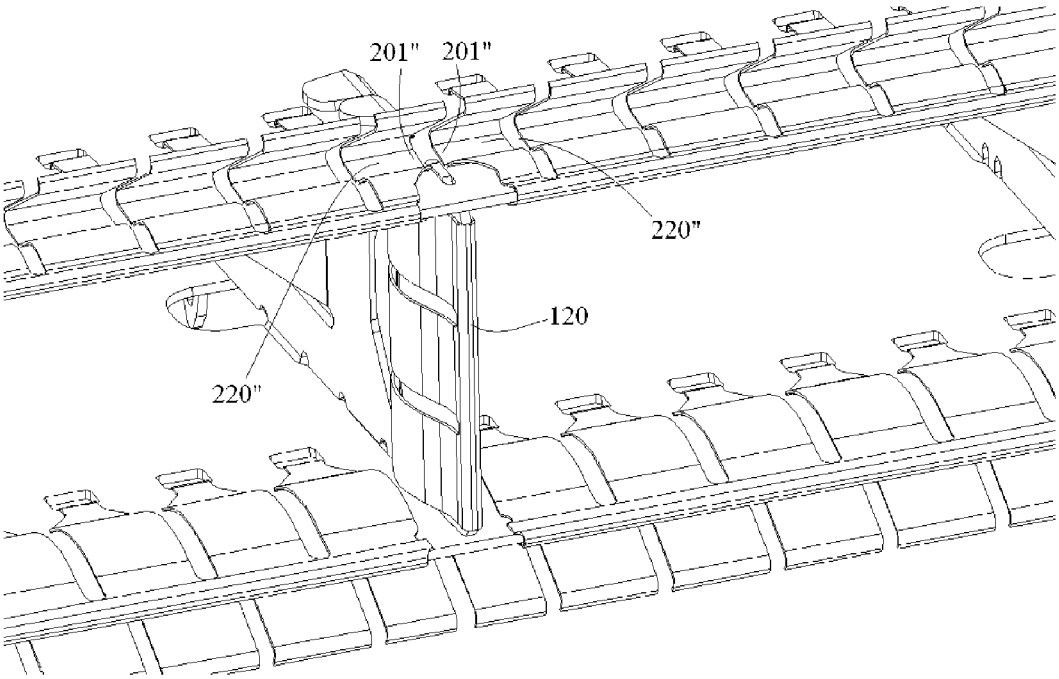
FIG. 4 is an enlarged view of a spacer of the shielding cage of FIG. 1.

As shown in FIGS. 4 and 6, the connection portion 230 is provided at an edge of the opening 101. The inner spring sheet portion 210 is located inside the shielding cage 100 and the outer spring sheet portion 220 extends to and is held on an outside of the shielding cage 100. An end 211 of the inner spring sheet portion 210 is engaged to a slot 130 of the shielding cage 100, as shown in FIG. 3, and the other end of the inner spring sheet portion 210 opposite to the one end 211 is connected to an end of the outer spring sheet portion 220, and the other end of the outer spring sheet portion 220 is a free end.

Figure 5:
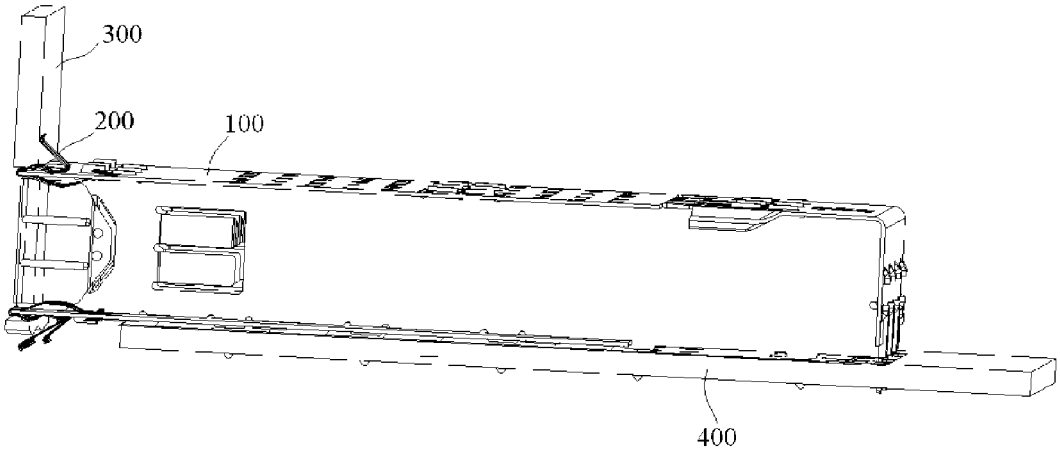
FIG. 5 is a side view of the shielding cage of FIG. 1 on an installation opening of an apparatus housing.

As shown in FIGS. 1, 5, and 6, a plurality of shielding spring sheets 200 held on an upper wall of each plug-in port 1011 are connected to each other to form a group of first spring sheets 200; a plurality of shielding spring sheets 200 held on a lower wall of each plug-in port 1011 are connected to each other to form a group of second spring sheets 200; a plurality of shielding spring sheets 200 held on a side wall of each outmost plug-in port 1011 are connected to each other to form a group of third spring sheets.

Two adjacent side portions 201' of the outer spring sheet portions 220' which belong to two adjacent shielding spring sheets 200', respectively, at a corner 110 of the opening 101, extend toward each other as shown in FIG. 3. The gap between the two adjacent shielding spring sheets 200' at the corner 110 is decreased, improving the capacity of anti-electromagnetic interference. Two adjacent side portions 201" of the outer spring sheet portions 220" which belong to two adjacent shielding spring sheets 200", respectively, at the spacer 120 project toward each other as shown in FIG. 4. The gap between the two adjacent shielding spring sheets 200" at the spacer 120 is decreased, improving the capacity of anti-electromagnetic interference. Due to the reduction of the gap between the outer spring sheet portions 220' at the corner 110 and the reduction between the outer spring sheet portions 220" at the spacer 120, the widths of the gaps between the outer spring sheet portions 220 of any two adjacent shielding spring sheets 200 are made to be substantially equal.

The connector including the shielding cage 100 may also have an apparatus housing 300 and a circuit board 400. The apparatus housing 300 has an installation opening side wall with an inner edge 310 and an inner surface 320, as shown in FIG. 6. The circuit board 400, shown in FIG. 5, may be any circuit board known to those with ordinary skill in the art.

The assembly of the shielding cage 100 with the apparatus housing 300 and circuit board 400 will now be described in greater detail.

As shown in FIGS. 5 and 6, the shielding cage 100 is plugged into the circuit board 400, and the opening 101 is directly held on the installation opening of the apparatus housing 300 via the outer spring sheet portion 220. When the shielding cage 100 is held on the installation opening of the apparatus housing 300, the outer spring sheet portion 220 comes into elastic and electrical contact with the shielding cage 100 and the apparatus housing 300 simultaneously.

As shown in FIG. 6, when the shielding cage 100 is held on the installation opening of the apparatus housing 300, there are a plurality of first elastic electric-contact points C11 and C12 and a plurality of second elastic electric-contact points C21 and C22 between the outer spring sheet portion 220 and an outer wall of the shielding cage 100. The outer spring sheet portion 220 comes into elastic and electrical contact with the inner edge 310 and the inner surface 320 of a side wall of the apparatus housing 300 simultaneously. The free end of the outer spring sheet portion 220 comes into elastic and electrical contact with the inner surface 320 of the side wall of the apparatus housing 300. The first bending portion 221 is pressed between the inner edge 310 of the installation opening of the apparatus housing 300 and the outer wall of the shielding cage 100; and when the shielding cage 100 is held on the installation opening of the apparatus housing 300, an end of the second bending portion 222 is pressed against the inner surface 320 of the side wall of the apparatus housing 300.

Advantageously, according to the aforementioned embodiments of the present invention, the shielding cage may be directly mounted and held on the installation opening of the apparatus housing via the outer spring sheet portions of anti-electromagnetic interference and extending to the outer wall of the shielding cage, thereby there is no need to provide a conductive gasket and a fixation plate for fixing the conductive gasket, and the cost of the connector is thus reduced. Furthermore, the outer spring sheet portion comes into elastic and electrical contact with the shielding cage and the apparatus housing simultaneously, thereby improving the effect of electromagnetic shield of the electric connector.

What is claimed is:

1. A shielding cage of a connector, comprising:

an opening defined by four walls and configured to receive a plug of a mating connector; and a plurality of shielding spring sheets held on the four walls, each shielding spring sheet having a first end on an inner spring sheet portion located inside the opening and an opposite second end on an outer spring sheet portion located outside the opening, the outer spring sheet portion having a first bending portion disposed along an outer wall of the shielding cage and a second bending portion connected to the first bending portion, the second bending portion extending away from the outer wall of the shielding cage to a free end at the second end of the shielding spring sheet.

2. The shielding cage of the connector according to claim 1, wherein the first end is fixed onto the shielding cage.

3. The shielding cage of the connector according to claim 2, wherein the shielding cage is adapted to be held on an installation opening of an apparatus housing via the outer spring sheet portion.

4. The shielding cage of the connector according to claim 3, wherein the outer spring sheet portion comes into elastic and electrical contact with the shielding cage and the apparatus housing simultaneously.

5. The shielding cage of the connector according to claim 4, wherein a plurality of first elastic electric-contact points are disposed between the outer spring sheet portion and an outer wall of the shielding cage.

6. The shielding cage of the connector according to claim 5, wherein a plurality of second elastic electric-contact points are disposed between the outer spring sheet portion and the apparatus housing.

7. The shielding cage of the connector according to claim 6, wherein the outer spring sheet portion comes into elastic and electrical contact with an inner edge of the installation opening of the apparatus housing and an inner surface of a side wall of the apparatus housing simultaneously.

8. The shielding cage of the connector according to claim 7, wherein the free end of the outer spring sheet portion comes into elastic and electrical contact with the inner surface of the side wall of the apparatus housing.

9. The shielding cage of the connector according to claim 8, wherein the first bending portion is pressed between the inner edge of the installation opening of the apparatus housing and the outer wall of the shielding cage.

10. The shielding cage of the connector according to claim 9, wherein an end of the second bending portion is pressed against the inner surface of the side wall of the apparatus housing.

11. The shielding cage of the connector according to claim 4, wherein two adjacent side portions of the outer spring sheet portions which belong to two adjacent shielding spring sheets extend toward each other at a corner of the opening, so as to decrease a gap between the two adjacent shielding spring sheets.

12. The shielding cage of the connector according to claim 4, wherein at least one spacer is provided in the opening to divide the opening into a plurality of plug-in ports.

13. The shielding cage of the connector according to claim 12, wherein two adjacent side portions of the outer spring sheet portions which belong to two adjacent shielding spring sheets project toward each other at the spacer, so as to decrease a gap between the two adjacent shielding spring sheets.

14. The shielding cage of the connector according to claim 13, wherein each shielding spring sheet has a connection portion located between the inner spring sheet portion and the outer spring sheet portion and used to connect the inner spring sheet portion to the outer spring sheet portion.

15. The shielding cage of the connector according to claim 14, wherein the connection portion of the shielding spring sheets is provided at an edge of the opening.

16. The shielding cage of the connector according to claim 15, wherein a plurality of shielding spring sheets on an upper wall of each plug-in port are connected to each other to form a group of first spring sheets, a plurality of shielding spring sheets on a lower wall of each plug-in port are connected to each other to form a group of second spring sheets, and a plurality of shielding spring sheets on a side wall of each outmost plug-in port are connected to each other to form a group of third spring sheets.

* * * * *